US006708613B2

(12) United States Patent
Faber

(10) Patent No.: US 6,708,613 B2
(45) Date of Patent: Mar. 23, 2004

(54) ELONGATED STAMPING DEVICE

(75) Inventor: Ernst Faber, Wels (AT)

(73) Assignee: Colop Stempelerzeugung Skopek GmbH & Co. KG, Wels (AT)

( * ) Notice: Subject to any disclaimer, the term of this patent is extended or adjusted under 35 U.S.C. 154(b) by 0 days.

(21) Appl. No.: 10/182,008

(22) PCT Filed: Nov. 29, 2000

(86) PCT No.: PCT/AT00/00319

§ 371 (c)(1),
(2), (4) Date: Jul. 23, 2002

(87) PCT Pub. No.: WO01/51294

PCT Pub. Date: Jul. 19, 2001

(65) Prior Publication Data

US 2003/0000400 A1 Jan. 2, 2003

(30) Foreign Application Priority Data

Jan. 28, 2000 (AT) ..... 59/2000 U

(51) Int. Cl.[7] ..... B43K 29/013; B41K 1/56

(52) U.S. Cl. ..... 101/333; 101/405; 401/195

(58) Field of Search ..... 101/327, 333, 101/334, 405, 406, 103; 401/195, 52, 117

(56) References Cited

U.S. PATENT DOCUMENTS

| | | | | | |
|---|---|---|---|---|---|
| 396,233 | A | * | 1/1889 | Reynolds | 101/333 |
| 1,085,143 | A | * | 1/1914 | Malsch | 101/333 |
| 3,216,352 | A | | 11/1965 | Schackel | 101/333 |
| 5,108,211 | A | | 4/1992 | Rigoni | 401/195 |
| 5,118,212 | A | * | 6/1992 | Shao | 401/195 |
| 6,290,419 | B1 | * | 9/2001 | Hirschmann | 401/195 |
| 6,526,882 | B1 | * | 3/2003 | Shih | 101/327 |

FOREIGN PATENT DOCUMENTS

| | | |
|---|---|---|
| CA | 2028611 | 3/1992 |
| DE | 30503 | 6/1885 |
| DE | 2827542 | 1/1980 |
| DE | 3243970 | 6/1983 |
| DE | 8604475 | 7/1987 |
| DE | 19526444 | 2/1996 |
| HU | P8700279 | 1/1987 |
| HU | P0100110 | 11/1998 |
| WO | 9937487 | 7/1999 |
| WO | WO 01/49511 A1 * | 7/2001 |

* cited by examiner

*Primary Examiner*—Leslie J. Evanisko
(74) *Attorney, Agent, or Firm*—Collard & Roe, P.C.

(57) ABSTRACT

An elongate stamping device (1), preferably in the form of a pen, comprising an ink pad support for an ink pad (10), the ink pad support being pivotably mounted on a handle (3), and a stamping plate (6) for a printing block (6'), the stamping plate being pivotably mounted on a holding arm (5), wherein, when in use, the stamping plate (6) rests on the ink pad (10) in the inking position with a printing block (6'), wherein the width (b', b) of the printing plate (6) or of the ink pad support (11), respectively, is larger than the entire thickness of the holding arm (5), the stamping plate (6) with the printing block (6') and the ink pad support (11) with the ink pad (10) in the inking position.

22 Claims, 12 Drawing Sheets

ELONGATED STAMPING DEVICE

CROSS REFERENCE TO RELATED APPLICATIONS

Applicant claims priority under 35 U.S.C. §119 of AUSTRIAN Application No. GM 59/2000 filed on Jan. 28, 2000. Applicant also claims priority under 35 U.S.C. §365 of PCT/AT00/00319 filed on Nov. 29, 2000. The international application under PCT article 21(2) was not published in English.

STATEMENT REGARDING FEDERALLY SPONSORED RESEARCH OR DEVELOPMENT (not applicable).

INCORPORATION-BY-REFERENCE OF MATERIAL SUBMITTED ON A COMPACT DISC (not applicable).

BACKGROUND OF THE INVENTION

1. Field of the Invention

The invention relates to an elongate stamping device, preferably in the form of a pen, comprising an ink pad support for an ink pad, the ink pad support being pivotably mounted on a handle, and a stamping plate for a printing block, the stamping plate being pivotably mounted on a holding arm, wherein, when in use, the stamping plate, in the inking position, rests on the ink pad with the printing block.

2. Description of the Prior Art

Pen-type stamping devices have already been known which possibly are even integrated into a writing tool, and which are compact and comfortable to take along. These stamping devices, however, have a very narrow stamping area, since the latter is restricted by the circular diameter of the pen-shaped stamping device, and thus it is not possible to accommodate a standard private stamp having a width of adequate size so as to accommodate the information required (e.g. name and address), since the diameter of the pen then would lie in a range in which the stamping device would not be handy anymore.

From CA 2 028 611 A, such a writing tool is known in which a pen-shaped stamping device can be screwed into the cap. The stamping device substantially consists of a holding means on which both a carrier for the ink pad as well as the stamping plate are pivotably mounted—on a holding arm. In the pivoted-in inking or resting position, ink pad and stamping plate will rest on each other resulting in the pen shape of the stamping device. Yet also there the width of the stamping plate is restricted to the diameter of the pen, resulting in a very restricted possibility of housing the stamp characters.

SUMMARY OF THE INVENTION

It is now an object of the invention to provide an elongate stamping device of the initially defined type, which has a comparatively large width of the stamping plate and thus allows for a larger stamping area, wherein a plurality of different stamping characters can be used, while still providing the user with a stamping device that is easy to use and which will rest well in the user's hand.

The inventive stamping device of the initially defined type is characterised in that the width of the stamping plate or of the ink pad support, respectively, is larger than the entire thickness of the holding arm, the stamping plate with the printing block and the ink pad support for the ink pad in the inking position. This results in an elongate stamping device which differs from the previously known stamping devices of generally circular cross-section and which has a substantially flat cross-sectional shape, enabling, on the one hand, a handy configuration capable of being inserted like a pen, and, on the other hand, a stamping area of larger width, whereby substantially more symbols or stamping characters can be housed, e.g. so as to provide a standard private stamp. When in use, the stamping plate and the ink pad are transferred from the closed inking position into an open stamping position in which the stamping plate is provided substantially perpendicularly to the longitudinal axis of the stamping device.

To prevent the stamping device from soiling something with its ink during transportation thereof and to maintain the stamping device in the inking position it is advantageous if in the inking position, a removable slip-on sleeve is provided which surrounds the holding arm, the stamping plate and the ink pad support and whose open end follows upon the handle.

For great ease of handling and for an optically pleasing shape, it is suitable if the cross-section of the sleeve is oval.

Likewise, it may be advantageous, e.g. for suitable stacking, if the cross-section of the sleeve is rectangular.

The surface of the sleeve is particularly well suited for advertisement prints, if the cross-section of the sleeve has two parallel partial regions which are interconnected via two curved partial regions.

For a high operating comfort despite a simple design, where the user has to do as little as possible by himself, it is advantageous if the stamping plate is mounted eccentrically on the holding arm so as to automatically pivot outwards into the stamping position on account of gravity when the sleeve is taken off.

For a comfortable handling it is also suitable if the bearing of the stamping plate on the holding arm is provided with a spring so as to automatically pivot outward into the stamping position when the sleeve is taken off.

For the stamping plate to be stopped in the stamping position when it pivots outwards, it is also advantageous if a stop for the stamping plate in its outward-pivoted position is provided on one side of the holding arm.

In order to enable the use of different stamping plates with different printing blocks in the stamping device it is suitable if the stamping plate is releasably connected with the holding arm, e.g. by a snap connection.

To attain the press-on pressure of the ink pad on the printing block required for inking it is suitable if the printing block has a thickness of between 1.7 and 2.3 mm.

To prevent think pad support from impeding the stamping procedure, it is advantageous if the plane defined by the ink pad support in the inking position encloses an obtuse angle with the longitudinal axis of the stamping device.

To render the transition from the closed inking position to the open stamping position as automatic as possible for the user, it is advantageous if the bearing of the ink pad support is provided with a spring so as to automatically pivot outwards into the stamping position when the sleeve is taken off.

Particularly with a view to the comparatively wide shape of the stamping device, it is suitable if the spring is a leg spring which is mounted on the pivot axis of the ink pad support.

To compensate for different heights of different printing blocks and to thus ensure a uniform support of the printing block on the ink pad in the inking position, it is suitable if an ink pad support arm of the ink pad support has a long hole for receiving a bearing pin, the longitudinal axis of the long hole extending substantially perpendicular to the longitudinal axis of the stamping device.

For a stamping area in which a plurality of different motives can be printed it is suitable if the printing block has a printing surface the width of which is larger than ⅓ of its length.

For using private stamps with standard dimensions it is advantageous if the printing block has a printing surface the width of which is larger than 9 mm and the length of which is larger than 35 mm, and which preferably has a width of 14 mm and a length of 38 mm.

To obtain a high number of prints without refilling the ink reservoir with ink, it is suitable if the height of the ink pad is larger than 2 mm, preferably is equal to 3 mm.

Despite the comparatively thick ink pad, the ink from the ink reservoir will be used up after several printing procedures, and thus the stamping device will not be usable any longer or will be usable to a limited extent only. Since a re-saturation with an ink bottle often will lead to imprints of lower quality, it is advantageous if the carrying arm is releasably connected with the ink pad support so as to allow for a simple exchange of pads and to allow for a long use of the stamping device.

The releasable connection can be realized in a particularly simple and inexpensive manner if the carrying arm is connected to the ink pad support via an e.g. dovetail-shaped insertion rail.

To secure the rail in longitudinal direction in the ink pad support, it is suitable if the insertion rail is connected with the ink pad support by means of latching projections.

BRIEF DESCRIPTION OF THE DRAWINGS

In the following, the invention will be explained in more detail by way of preferred exemplary embodiments illustrated in the drawings to which, however, it shall not be restricted. In detail, in the drawings.

DETAILED DESCRIPTION OF THE INVENTION

Figure 1:
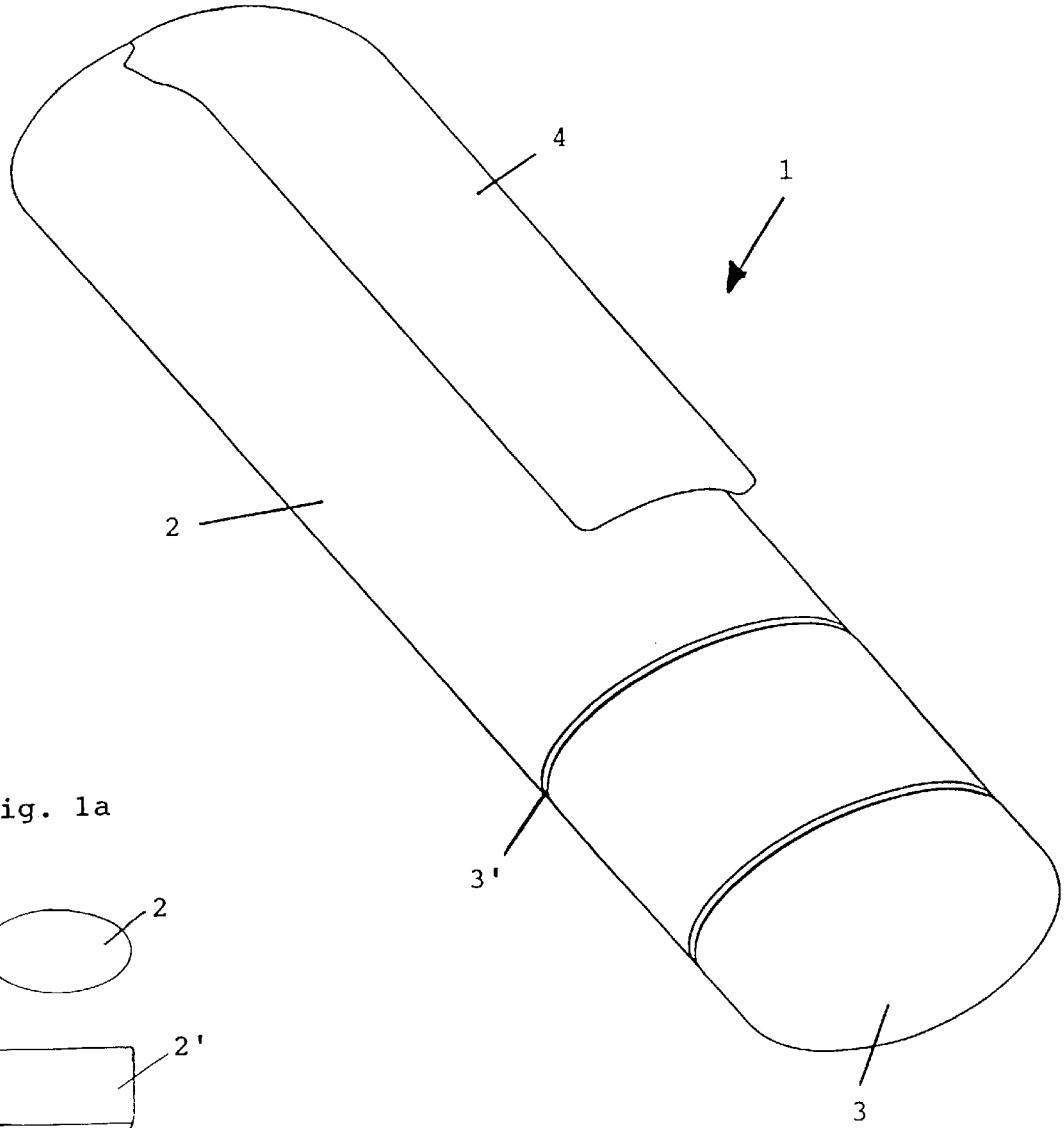
FIG. 1 shows a perspective view of a closed stamping device in the resting position comprising a sleeve.

FIG. 1 shows a perspective view of a stamping device 1 comprising a sleeve 2. At 3', the handle 3 of the stamping device 1 abuts on the open, front-side end of sleeve 2. Sleeve 2 comprises a clip 4 which assists in putting the stamping device 1 in breast pockets, e.g.

Figure 1A:
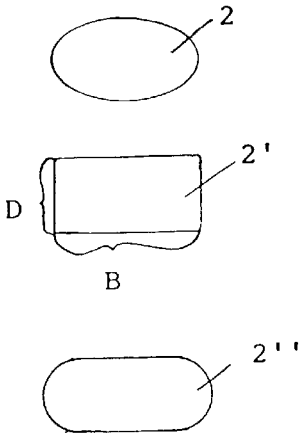
FIG. 1*a* schematically shows different cross-sectional shapes of the flattened stamping device.

In FIG. 1*a,* different cross-sectional shapes of the slip-on sleeve are schematically shown, the slip-on sleeve 2 having an elliptical cross-section. Further preferred embodiments have a rectangular cross-section 2' or a long-hole-shaped cross-section 2", which is comprised of two parallel edges and two segments of a circle. All the cross-sectional shapes 2, 2' and 2" share the feature that width B is larger than thickness D, and thus a large stamping area is achieved with great ease of handling.

Figure 2:
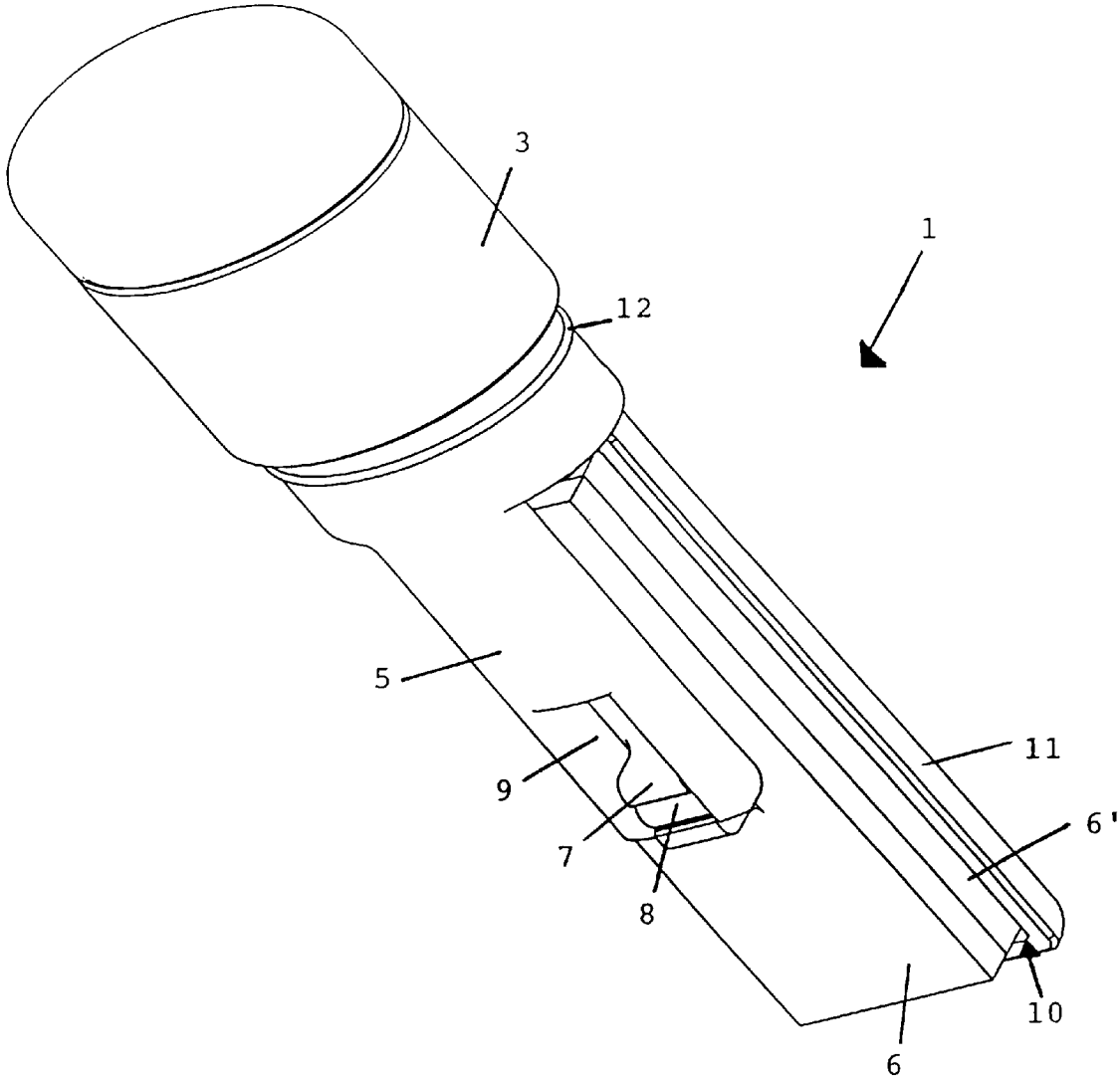
FIG. 2 shows a perspective view of the stamping device in the closed resting or inking position, respectively, yet without the sleeve.

FIG. 2 shows a perspective view of the stamping device 1 in a closed inking position, with sleeve 2 having been omitted. Handle 3 is followed by a holding arm 5 on which a stamping plate 6 is mounted so as to be pivotable about an axle 8 that extends transversely to the longitudinal direction of the stamping device 1. To realize the pivotable mounting, a gripping part 7 (with snapping projections) of the stamping plate 6 comprises the axle 8 of the holding arm 5, which axle is provided in a recess 9 of the holding arm 5. This results in an easily pivotable and well releasable mounting which allows for a simple exchange or insertion of different stamping plates 6. The printing block 6' glued to the stamping plate 6 has an area contact on an ink pad 10 which is glued into an ink pad support 11. For a positive-fit and frictional engagement between sleeve 2 and handle 3, handle 3 is provided with a bead 12 which, in the closed state, will snap into a corresponding groove (not illustrated) on the inner side of sleeve 2.

Figure 3:
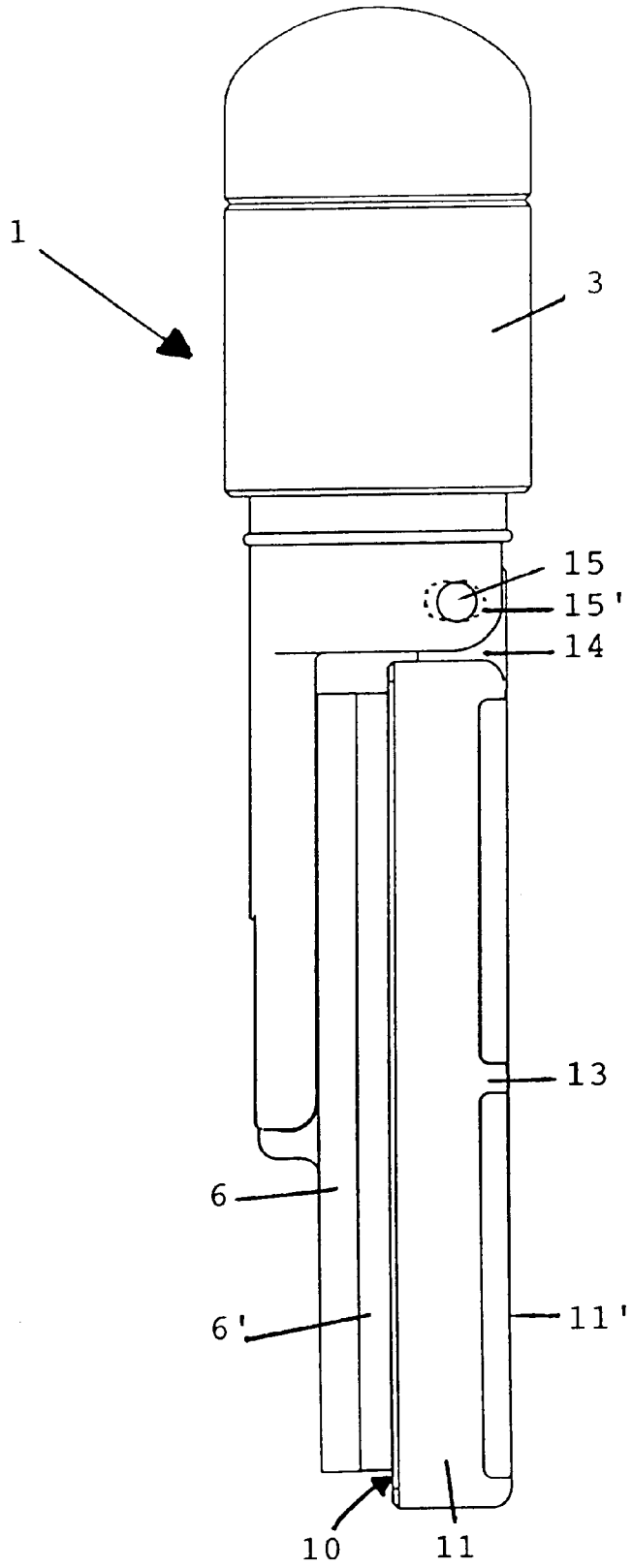
FIG. 3 shows a side view of a stamping device in the closed inking position.

FIG. 3 shows a side-view of the stamping device 1 with the ink pad 10 and the stamping plate 6 in the closed inking position, in which the printing block 6' glued to the stamping plate 6 rests on the ink pad 10 with its entire surface. The ink pad 10 is glued to the ink pad support 11 which has reinforcing ribs 13, e.g. in cross-shaped arrangement (cf. FIG. 4) on its rear side 11'. Via a forked carrying arm 14, the ink pad support 11 is connected to the handle 3 so as to be pivotable about a bearing pin 15. Moreover, a long hole 15' is entered in broken lines in carrying arm 14, whereby the ink pad support 11 in the inking position has a slight play perpendicularly to the longitudinal direction of the stamping device 1 and thus different thicknesses of the printing block 6' are possible.

Figure 4:
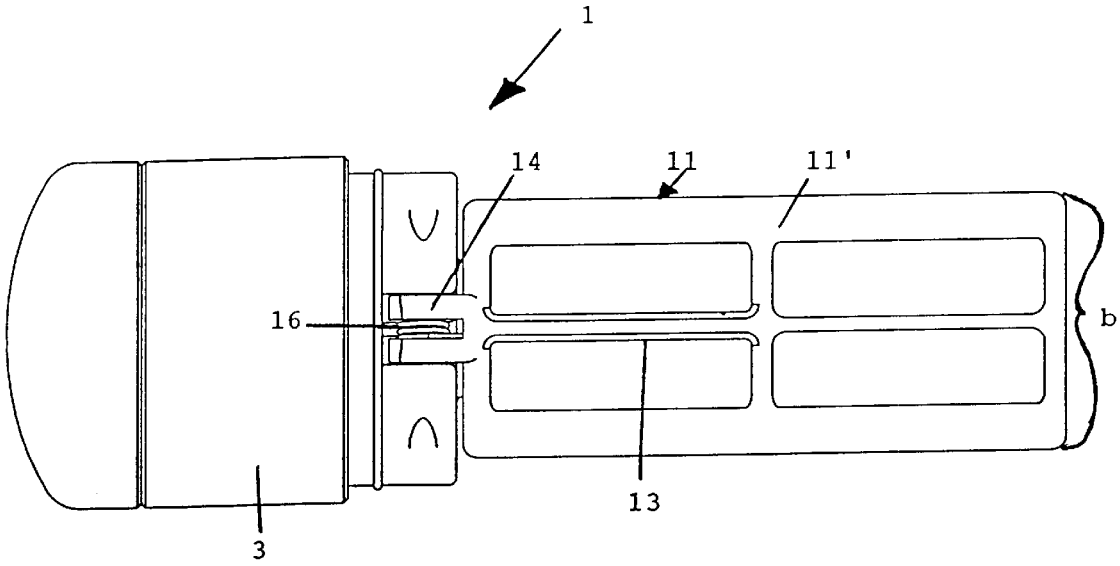
FIG. 4 shows a view of the stamping device onto the rear side of the ink pad support in the closed inking position.

In FIG. 4, the hinging of the ink pad support 11 to the handle 3 via the forked ink pad support arm 14 can be seen in top view. Moreover, a spring 16 can be seen between the two fork arms of the ink pad support arm 14, which causes automatic outward pivoting of the ink pad support 11 when the sleeve 2 is taken off. In the view of FIG. 4, the broad side of the stamping device 1 is shown with an elliptical cross-section, wherein the width b of the ink pad support 11 may be larger than in a stamping device having a circular cross-section.

Figure 5:
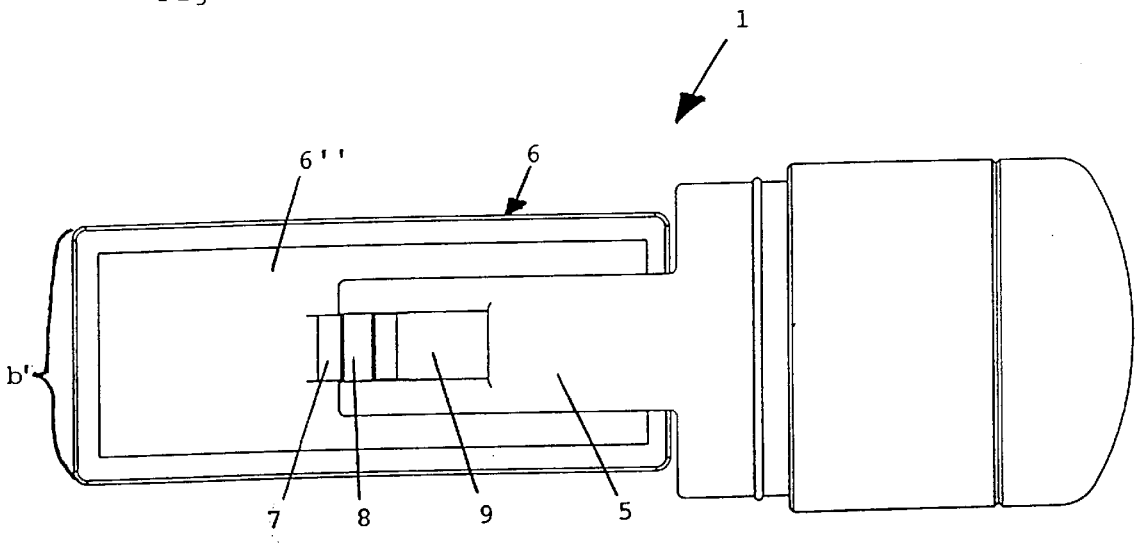
FIG. 5 shows a view of the stamping device onto the rear side of the stamping plate in the closed inking position.

FIG. 5 shows a view of the stamping device 1 onto the rear side 6" of the stamping plate 6. In this instance, the releasable bearing of the stamping plate 6 by aid of the gripping part 7 on axle 8 of the holding arm 5 can be seen. For as compact a construction as possible, the holding arm 5 has an opening 9 which allows the gripping part 7 to engage on axle 8. Also in FIG. 5, the broad side of the stamping device 1 is shown, whereby the width b' of the stamping plate 6 is particularly clearly visible, which is larger as compared to circular, pen-shaped stamping device.

Figure 7:
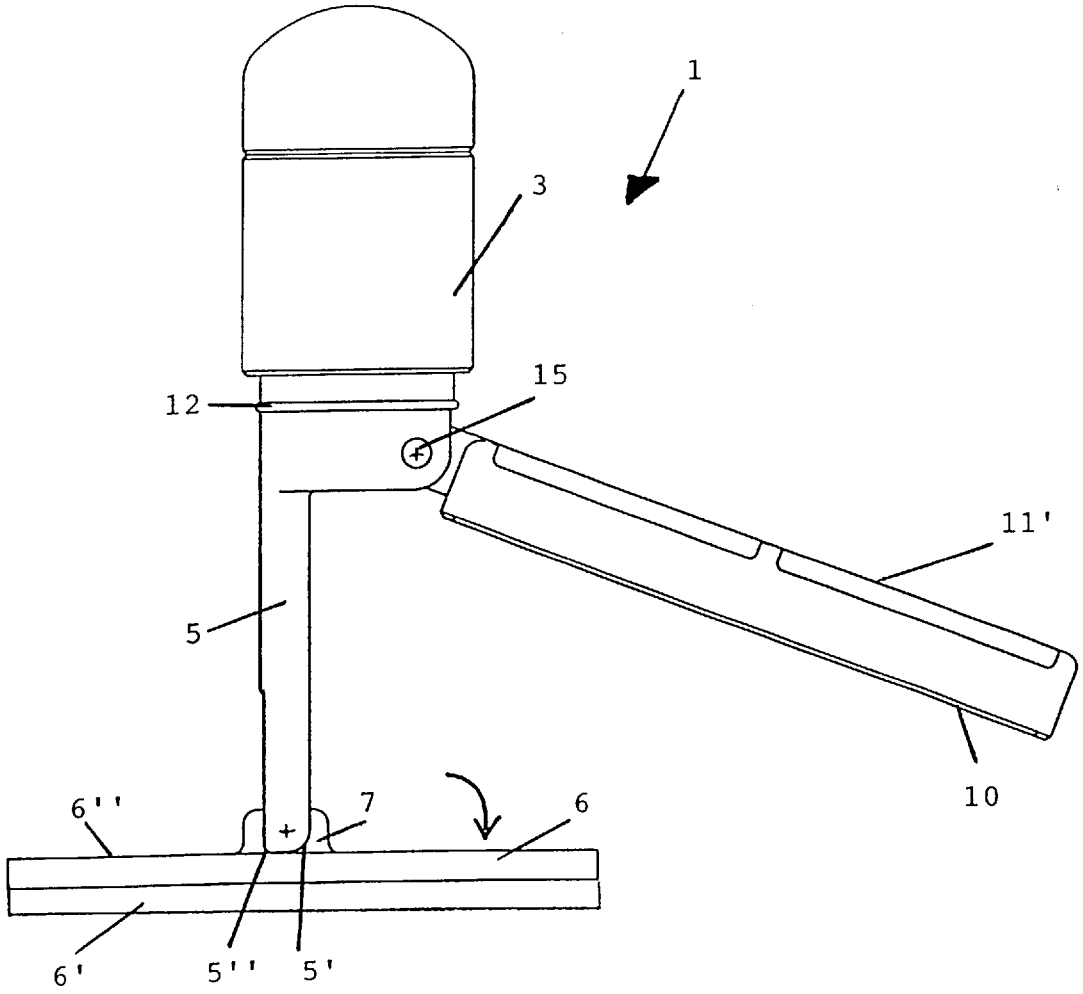
FIG. 7 shows a side view of the stamping device in the open stamping position.

As is moreover visible from FIG. 7, the front-side end of the holding arm 5, which is rounded on one side at 5', so as to allow for the pivoting of the stamping plate 6, forms a stop 5" with the one rim so as to delimit the pivoting movement of the stamping plate 6.

Figure 6:
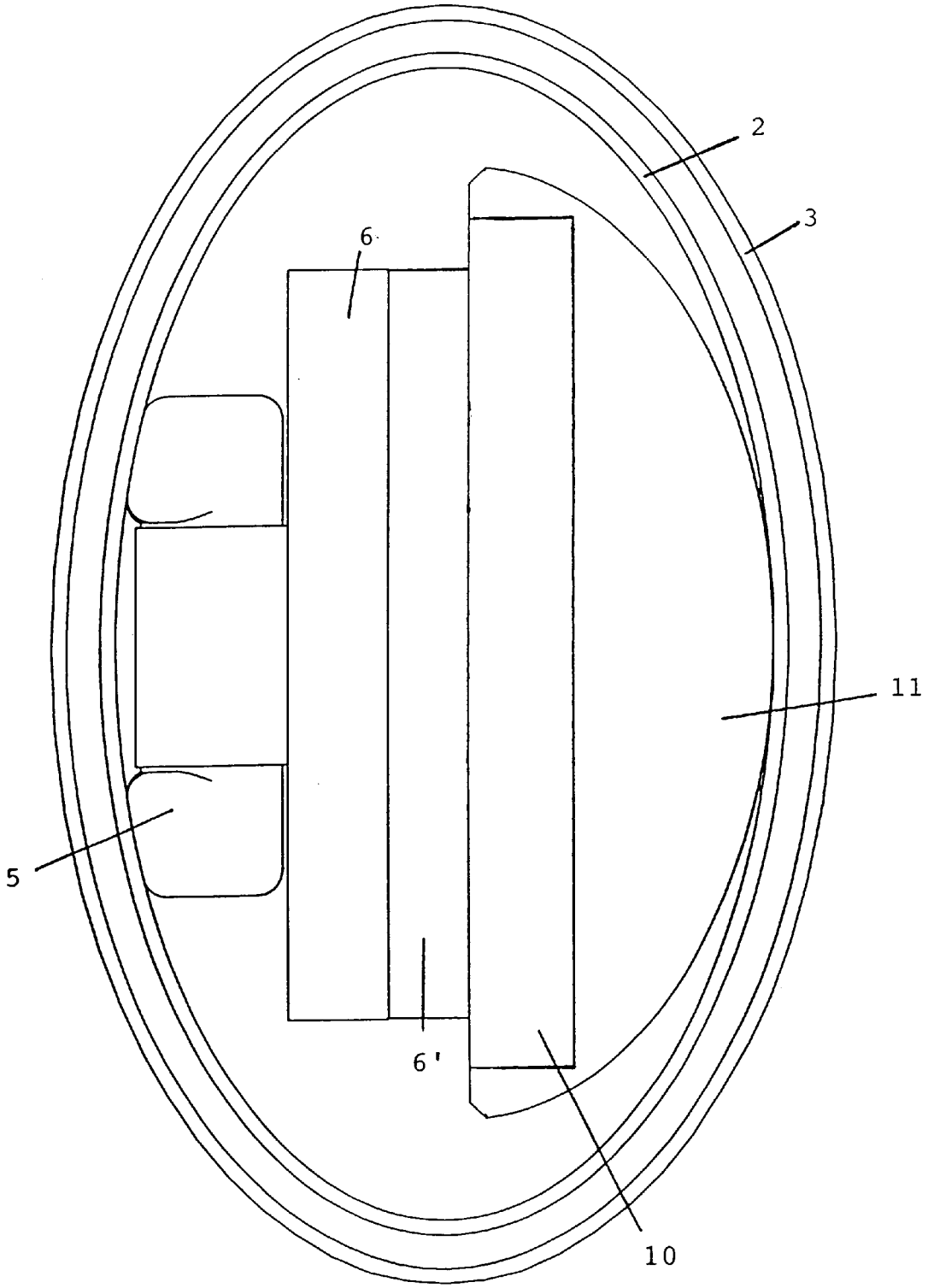
FIG. 6 shows a cross-section of the stamping device in the closed inking position, with sleeve.

In FIG. 6, a schematic cross-section of the stamping device 1 is shown in the closed inking position with the sleeve 2 slipped thereover, wherein it is visible that the printing block 6' contacts the ink pad 10, resulting in an inking of the stamp characters. The ink pad support 11 has a hemiellipsoidal cross-section, whereby the sleeve 2, once it has been slipped on, can exert a pressure on the ink pad support 11 so as to press it against the stamping plate 6. Moreover, it is visible that the sleeve 2 completely encloses the ink pad support 11 with the ink pad 10 and the holding arm 5 with the stamping plate 6.

In FIG. 7, the stamping device 1 is shown in the open stamping position. After removing the sleeve 2 from the handle 3, the stamping plate 6 mounted on the holding arm 5 pivots into a horizontal position, cf. the arrow in FIG. 7, which is attained by an eccentrical arrangement of the gripping part 7 on the stamping plate 6, whereby the stamping plate 6, when holding the stamping device in the position illustrated in FIG. 7, simply pivots downwards on account of gravity until it arrests on stop 5", as illustrated. In this horizontal position, the printing block 6' may simply be pressed onto a substrate on account of its substantially perpendicular position relative to the holding arm 5. Since it is spring-loaded, the ink pad support 11 will pivot upwardly about the axis of rotation 15 so as not to impede the stamping procedure. This automatic outward pivoting of the ink pad support is attained by means of the spring 16 shown in FIG. 4.

The stamping device 1 may be returned into the closed inking position in a simple manner, by pressing with one finger each against the rear side 6" of the stamping plate 6 and against the rear side 11' of the ink pad support 11, whereby these two parts 6, 11 are returned into their parallel, mutually abutting inking position. To fix it in the inking position, the sleeve 2 is slipped on until it snaps in over the bead 12 on handle 3.

Figure 8:
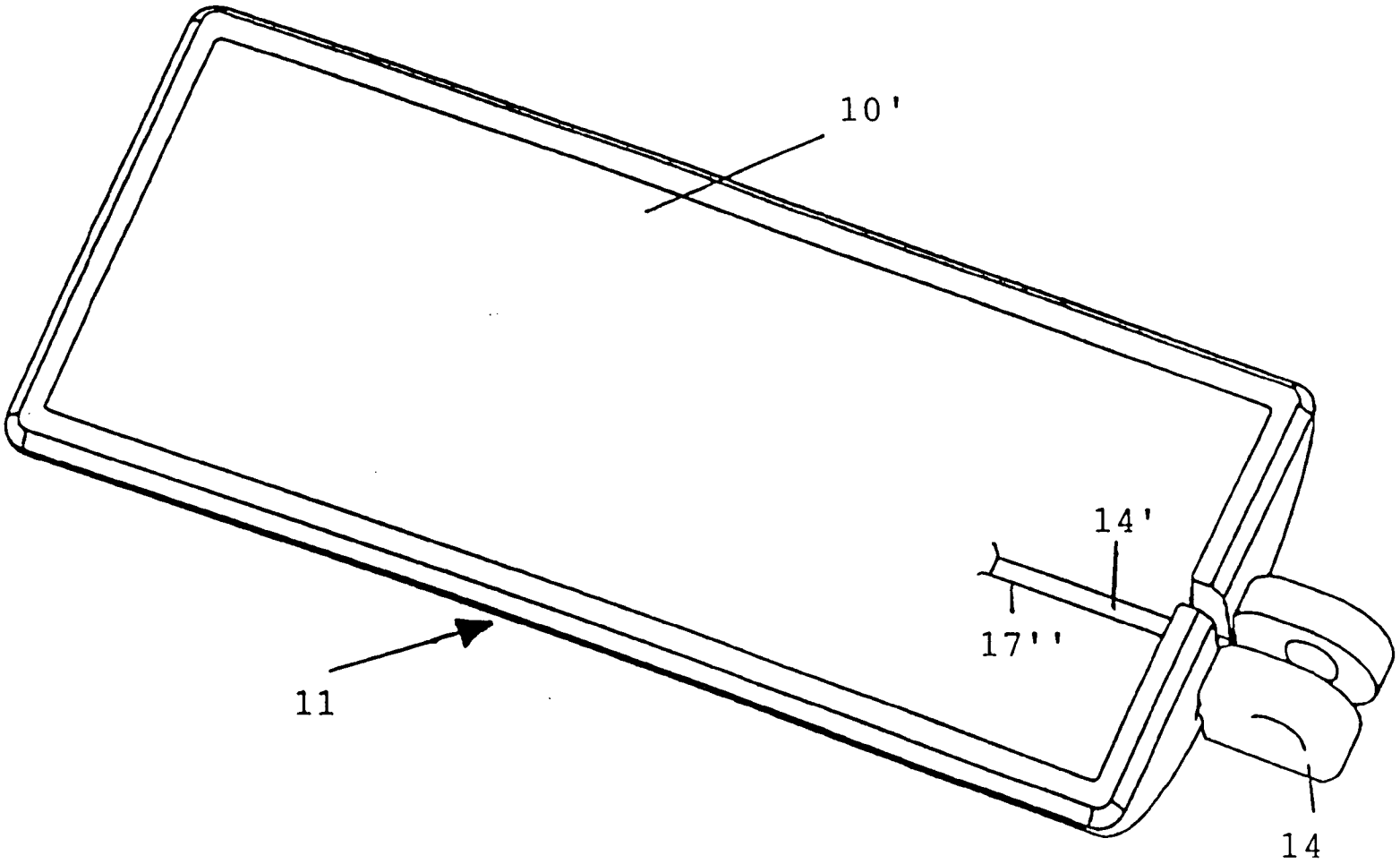
FIG. 8 shows a perspective view of an exchangeable ink pad support.

In FIG. 8, an ink pad support 11 comprising an exchangeable rail 14' is shown on which the forked carrying arm 14 of the ink pad support 11 is attached in one piece. In doing so, also the rectangular depression 10' for accommodating an ink pad 10 (cf. also FIG. 6) is visible. Moreover, a slit-shaped recess 17" can be seen in the body of the ink pad support 11 in the vicinity of the forked carrying arm 14, which serves to receive a leg of spring 16 (cf. also FIG. 12) which is designed as a leg spring.

Figure 9:
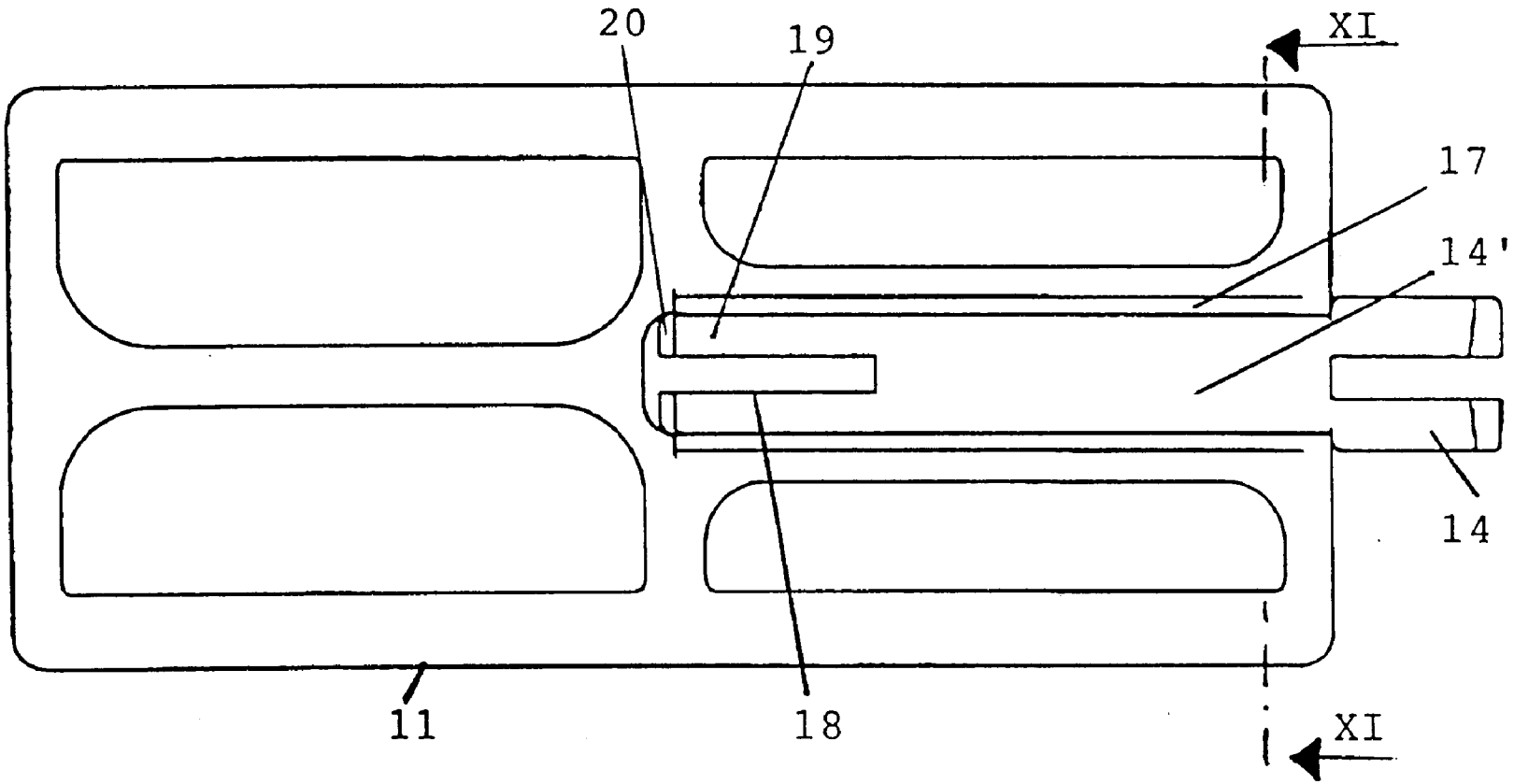
FIG. 9 shows a view onto the rear side of the ink pad support with an inserted rail.
Figure 11:
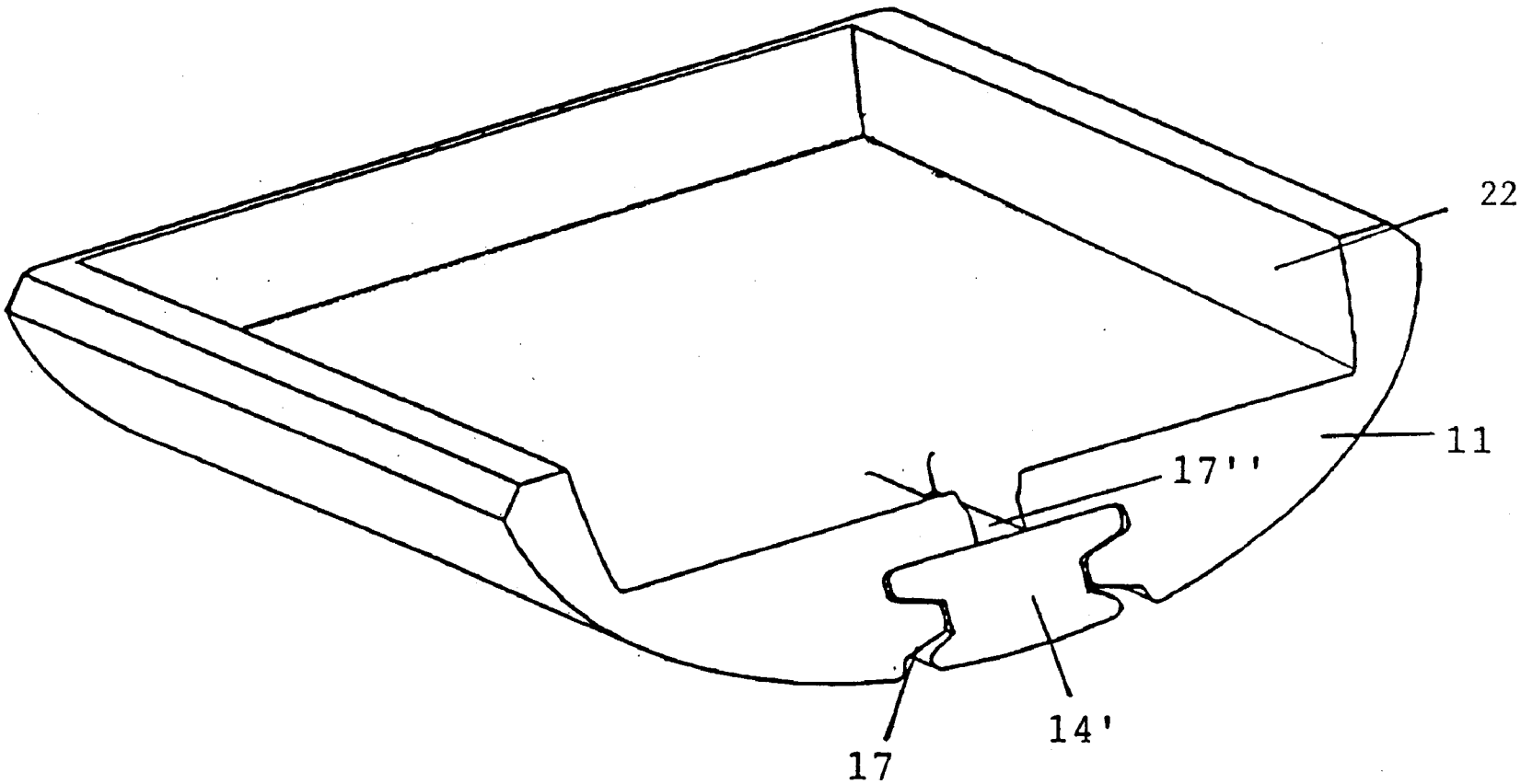
FIG. 11 shows a perspective sectional view according to line XI—XI of FIG. 9.

In FIGS. 9 and 11, rail 14' which is dovetail-shaped in cross-section can be seen in its inserted position in the ink pad support 11. To facilitate insertion of the rail 14' in the recess 17 in the ink pad support 11, the rail 14' has a slot 18 in its starting region, whereby two resilient tongues 19 are formed which can be pressed together so as to allow for an easier insertion in recess 17. Moreover, rail 14' according to FIG. 9 has beads 20 on its head side which ensure an enhanced frictional engagement of rail 14' in recess 17.

Figure 10:
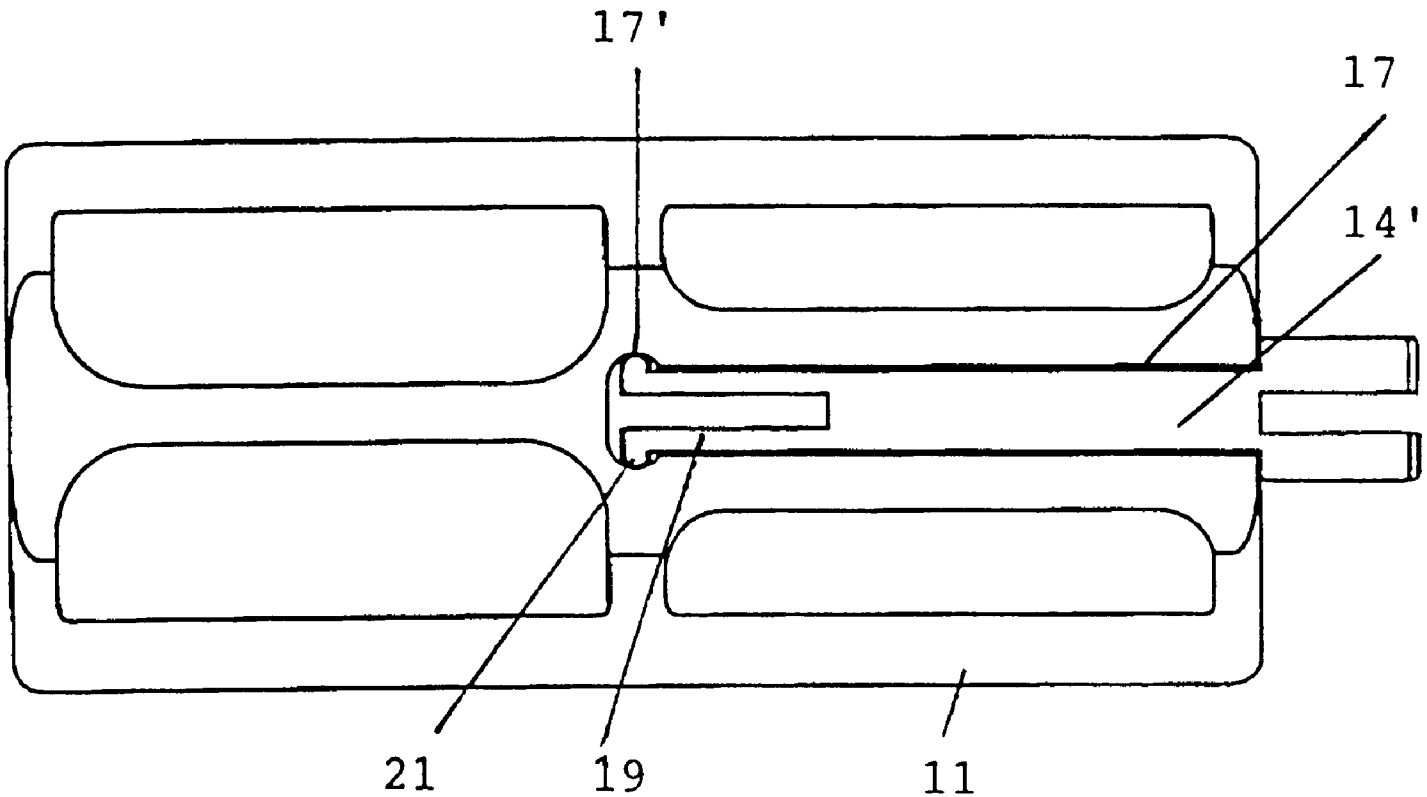
FIG. 10 shows a view onto the rear side of the ink pad support with a rail comprising a latching hook.

In FIG. 10, a rail 14' somewhat modified relative to FIG. 9 is shown in its inserted position in the ink pad support 11, wherein the rail 14' in its head region at the end of the two resilient tongues 19 has latching hooks 21 which snap into an enlarged recess 17' and thus axially secure the rail 14' in the recess 17. To exchange the ink pad support 11, the two tongues 19 must be pressed towards each other so as to move the latching hooks 21 out of the recess 17'.

FIG. 11 shows a schematic perspective sectional representation according to line XI—XI of FIG. 9. In this instance, the dovetail-shape of rail 14' can be seen which allows for a positive-fit or frictional connection between the recess 17 in the ink pad support 11 and the rail 14. Moreover, the gap-shaped recess 17" in the vicinity of the carrying arms 14 is visible which provides for a play of the carrying arm 11 when inserting the rail 14'. Also, the frame-shaped recess 22 for accommodating the ink pad 10 (cf. FIG. 6) can be seen.

Figure 12:
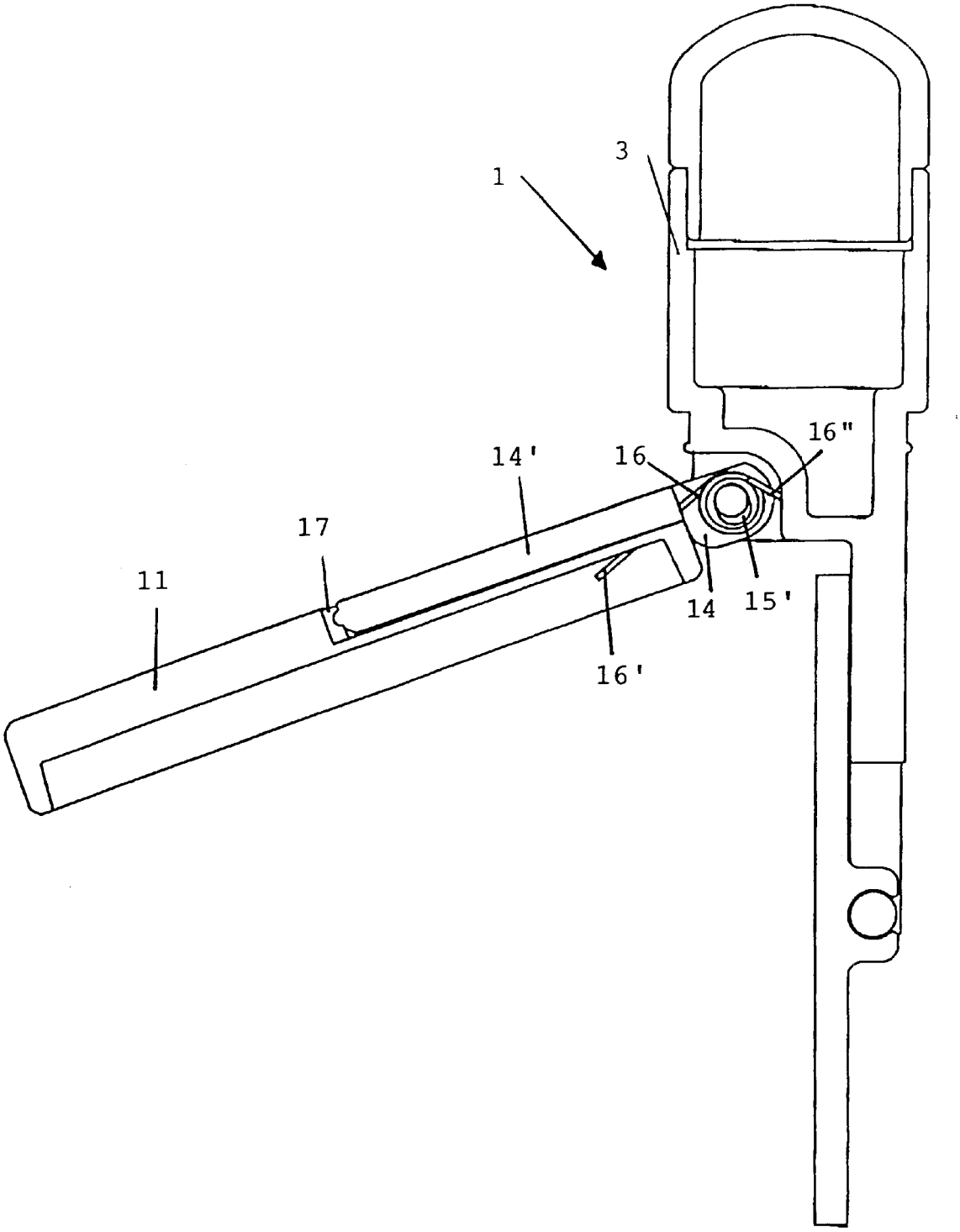
FIG. 12 shows a schematic cross-section of the stamping device with an ink pad support slipped onto a rail.

In FIG. 12, a cross-section of the stamping device 1 with outward-pivoted ink pad support 11 is shown. The ink pad support 11 is slipped onto the rail 14', whereby it can simply be exchanged in case of a lack of ink. In the sectional representation, also the leg spring 16 can be seen which is provided between the two fork arms of the carrying arm 14. By abutment of the one spring leg 16', which engages in the slit-shaped recess 17" (cf. FIG. 11), the leg spring 16 is wound up on the ink pad support 11, and by abutment of the other spring leg 16" on handle 3 when the ink pad support 11 is pivoted into the inking position. Due to the relatively broad cross-sectional shape of the stamping device 1, the leg spring 16 can be housed between the two fork arms of the carrying arm 14 without any problems, whereas in case of thin stamping devices of round cross-section, a separate axle must be provided to accommodate the leg spring because of the narrow space available.

Moreover, in FIG. 12 the long hole 15' in the carrying arm 15 is visible, which serves to compensate for different printing block thicknesses in the inking position (cf. also FIG. 3).

What is claimed is:

1. An elongate stamping device comprising an ink pad support with an ink pad, the ink pad support being pivotably mounted on a handle, a stamping plate with a printing block, the stamping plate being pivotably mounted on a holding arm, wherein the stamping plate rests on the ink pad in an inking position with the printing block, the printing plate and the ink pad support having a width which is larger than the entire thickness extending perpendicularly to the width of the holding arm, the stamping plate with the printing block and the ink pad support with the ink pad in the inking position, and a removable slip-on sleeve provided in the inking position, the removable slip-on sleeve surrounding the holding arm, the stamping plate and the ink pad support, and having an open end adjacent the handle.

2. A stamping device according to claim 1, wherein the sleeve has an oval cross-section.

3. A stamping device according to claim 1, wherein the sleeve has a rectangular cross-section.

4. A stamping device according to claim 1, wherein the sleeve has two parallel partial regions which are interconnected via two curved partial regions.

5. A stamping device according to claim 1, wherein the stamping plate is mounted eccentrically on the holding arm so as to automatically pivot outwards into a stamping position on account of gravity when the sleeve is taken off.

6. A stamping device according to claim 5, wherein a stop for the stamping plate in its outward-pivoted position is provided on one side of the holding arm.

7. A stamping device according to claim 1, wherein the stamping plate is positioned on the holding arm with a spring so as to automatically pivot outward into a stamping position when the sleeve is taken off.

8. A stamping device according to claim 1, wherein the stamping plate is releasably connected with the holding arm by a snap connection.

9. A stamping device according to claim 1, wherein the printing block has a thickness of between 1.7 and 2.3 mm.

10. A stamping device according to claim 1, wherein the plane defined by the ink pad support in the inking position encloses a substantially right angle with the longitudinal axis of the stamping device.

11. A stamping device according to claim 10, wherein the ink pad support is supported on a spring so as to automatically pivot outwards into a stamping position when the sleeve is taken off.

12. A stamping device according to claim 11, wherein the spring is a leg spring which is mounted on the pivot axis of the ink pad support.

13. A stamping device according to claim 1, wherein a carrying arm of the ink pad support has a long hole for receiving a bearing pin, the longitudinal axis of the long hole extending substantially perpendicular to the longitudinal axis of the stamping device.

14. A stamping device according to claim 13, wherein the carrying arm is releasably connected with the ink pad support.

15. A stamping device according to claim 14, wherein the carrying arm is connected to the ink pad support via a dovetail-shaped insertion rail.

16. A stamping device according to claim 15, wherein the insertion rail is connected with the ink pad support by means of latching projections.

17. A stamping device according to claim 1, wherein the printing block has a printing surface the width of which is larger than ⅓ of its length.

18. A stamping device according to claim 1, wherein the printing block has a printing surface the width of which is larger than 9 mm and the length of which is larger than 35 mm.

19. A stamping device according to claim 18, wherein the printing surface has a width of 14 mm and a length of 38 mm.

20. A stamping device according to claim 1, wherein the ink pad has a height which is larger than 2 mm.

21. A stamping device according to claim 20, wherein the height is equal to 3 mm.

22. A stamping device according to claim 1, in the form of a pen.

* * * * *